US011504584B2

(12) United States Patent
Shinohara et al.

(10) Patent No.: US 11,504,584 B2
(45) Date of Patent: Nov. 22, 2022

(54) GOLF BALL

(71) Applicant: BRIDGESTONE SPORTS CO., LTD., Tokyo (JP)

(72) Inventors: Hirotaka Shinohara, Tokyo (JP); Masanobu Kuwahara, Tokyo (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 17/321,506

(22) Filed: May 17, 2021

(65) Prior Publication Data

US 2021/0387058 A1 Dec. 16, 2021

(30) Foreign Application Priority Data

Jun. 10, 2020 (JP) ..... JP2020-101133

(51) Int. Cl.
*A63B 37/06* (2006.01)
*A63B 37/00* (2006.01)

(52) U.S. Cl.
CPC .... *A63B 37/00495* (2020.08); *A63B 37/0004* (2013.01); *A63B 37/0039* (2013.01); *A63B 37/00223* (2020.08); *A63B 37/00376* (2020.08)

(58) Field of Classification Search
CPC ..... A63B 37/0045; A63B 37/0039
USPC ..... 473/373
See application file for complete search history.

(56) References Cited

U.S. PATENT DOCUMENTS

| | | | | |
|---|---|---|---|---|
| 6,315,681 | B1 * | 11/2001 | Sullivan | A63B 37/0024 473/337 |
| 7,901,301 | B2 * | 3/2011 | Morgan | A63B 37/007 473/377 |
| 9,283,443 | B1 | 3/2016 | Hanna et al. | |
| 2003/0114250 | A1 * | 6/2003 | Nesbitt | A63B 37/0003 473/378 |
| 2018/0207490 | A1 * | 7/2018 | Hong | A63B 37/0075 |
| 2022/0062714 | A1 * | 3/2022 | Takubo | A63B 37/00373 |

* cited by examiner

*Primary Examiner* — Raeann Gorden
(74) *Attorney, Agent, or Firm* — Kenja IP Law PC

(57) ABSTRACT

A golf ball of the present disclosure includes an inner ball and a cover layer that covers the outer surface of the inner ball and includes an outer surface with dimples. The inner ball includes an inner layer, which includes an outer surface with a recess, and an inner film that covers only the surface of the recess on the outer surface of the inner layer. The inner layer and the inner film are different colors from each other, and the cover layer is transparent or semi-transparent. Peeling of the film can be suppressed in the golf ball.

6 Claims, 13 Drawing Sheets

GOLF BALL

TECHNICAL FIELD

The present disclosure relates to a golf ball.

This application is based on and claims priority to Japanese patent application No. 2020-101133, filed on Jun. 10, 2020, the entire content of which is incorporated herein by reference.

BACKGROUND

A known golf ball has a coating formed by printing or painting on the outer circumferential side of a cover layer. For example, see patent literature (PTL) 1.

CITATION LIST

Patent Literature

PTL 1: U.S. Pat. No. 9,283,443B1

SUMMARY

The above-described golf ball has the problem, however, of the coating easily peeling due to impact, such as when the ball is hit.

It would be helpful to provide a golf ball that can reduce peeling of the coating.

A golf ball of the present disclosure includes:

an inner ball; and a cover layer covering an outer surface of the inner ball and comprising an outer surface with dimples, wherein the inner ball comprises an inner layer comprising an outer surface with a recess; and an inner film covering only a surface of the recess on the outer surface of the inner layer, the inner layer and the inner film are different colors from each other, and the cover layer is transparent or semi-transparent.

In the golf ball of the present disclosure, a visible light transmittance of the cover layer is preferably 70% or more.

In the golf ball of the present disclosure, a depth of the recess is preferably 5 mm or less.

The golf ball of the present disclosure preferably further includes a coating layer positioned on an outer circumferential side of the cover layer, wherein the coating layer includes matte particles.

In the golf ball of the present disclosure, the inner film preferably includes a two-component curable polyurethane that uses a polyol and a polyisocyanate.

In the golf ball of the present disclosure, the cover layer preferably includes a gate trace of injection molding, and the inner film preferably does not overlap the gate trace in a radial direction.

In the golf ball of the present disclosure, a stamp is preferably formed on an outer circumferential side of the cover layer, and the inner film preferably does not overlap the stamp in a radial direction.

The present disclosure can provide a golf ball that can reduce peeling of the coating.

DETAILED DESCRIPTION

A golf ball of the present disclosure can be used as any type of golf ball, such as a two-piece golf ball, a three-piece golf ball, a four-piece golf ball, a five-piece golf ball, a six-piece golf ball, or a wound golf ball.

Embodiments of a golf ball according to the present disclosure are described below with reference to the drawings.

Constituent elements that are common across drawings are labeled with the same reference signs.

An example golf ball manufacturing method for obtaining a golf ball according to an embodiment of the present disclosure is described below with reference to FIGS. 1 to 12. The golf ball manufacturing method for obtaining a golf ball according to the present embodiment includes an inner layer molding step, an inner film formation step, a drying step, an inner film removal step, a cover layer molding step, a surface treatment step, a printing step, and a coating layer formation step. Each step is described below.

[Inner Layer Molding Step]

Figure 1:
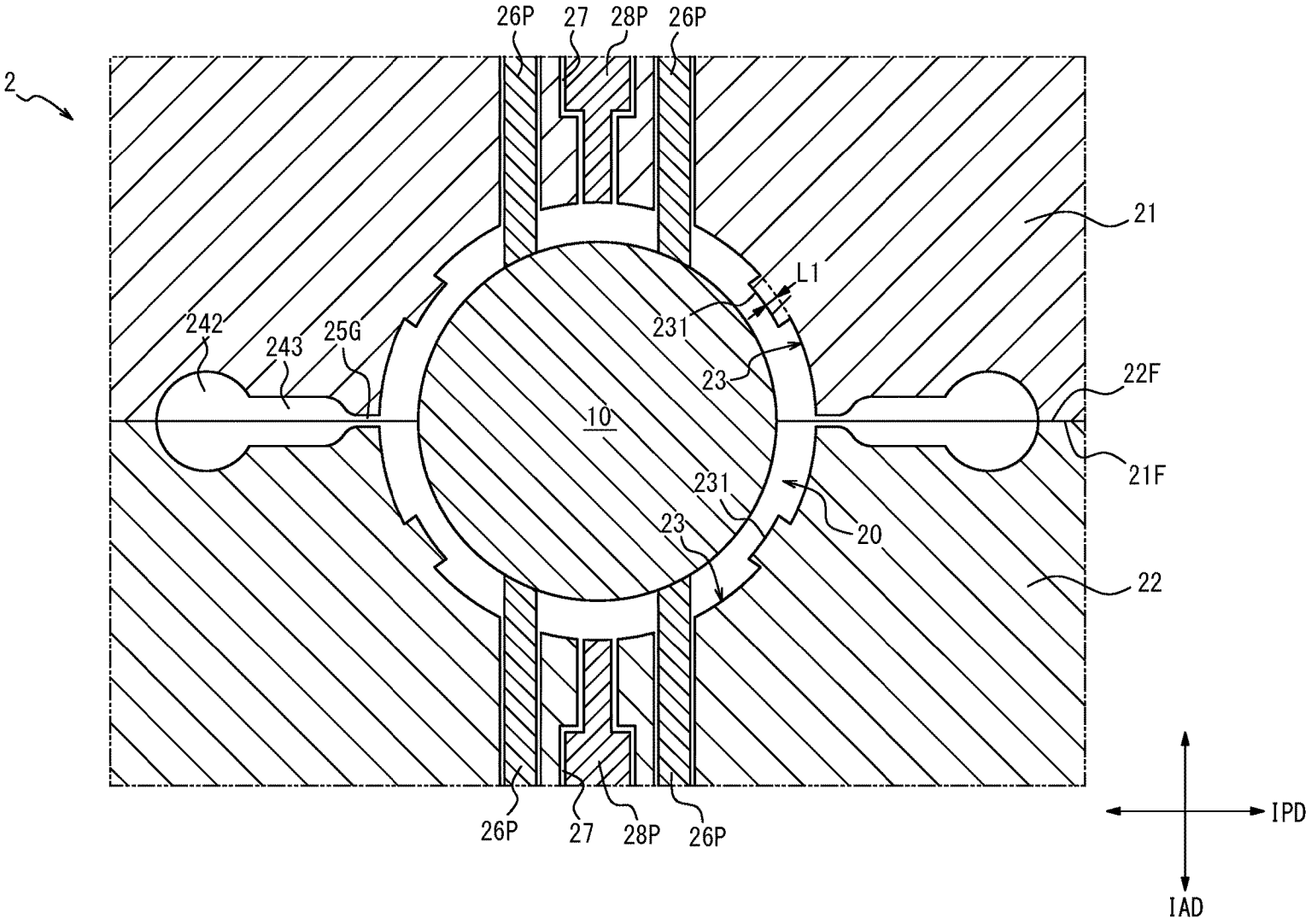
FIG. 1 illustrates an inner layer molding step in an example golf ball manufacturing method for obtaining a golf ball according to an embodiment of the present disclosure and is a cross-sectional diagram in the axial direction of a mold for inner layer molding to schematically illustrate the mold for inner layer molding used in the inner layer molding step.
Figure 2:
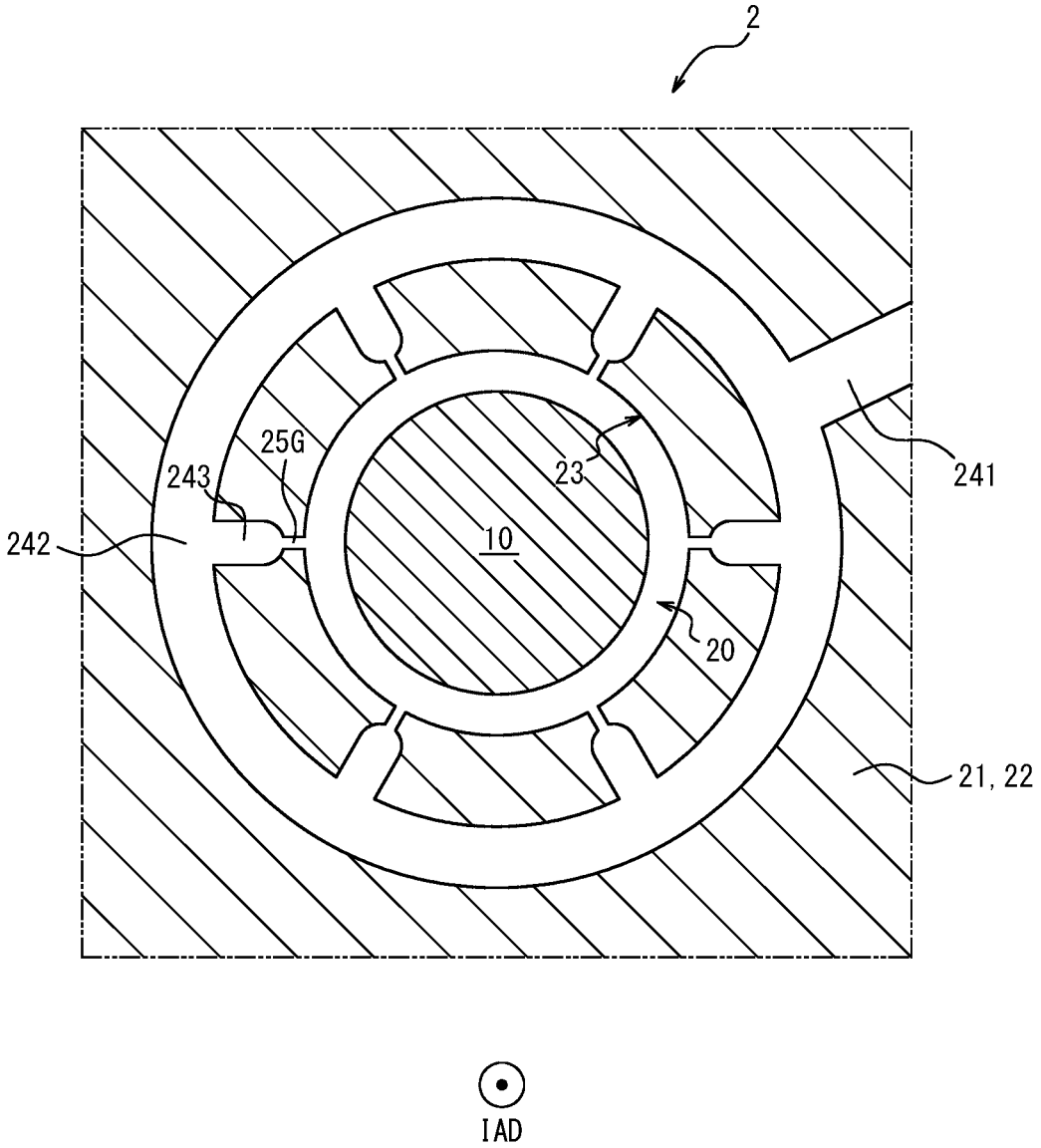
FIG. 2 illustrates an inner layer molding step in an example golf ball manufacturing method for obtaining a golf ball according to an embodiment of the present disclosure and is a cross-sectional diagram in the perpendicular-to-axis direction of the mold for inner layer molding to illustrate the mold for inner layer molding of FIG. 1.
Figure 3:
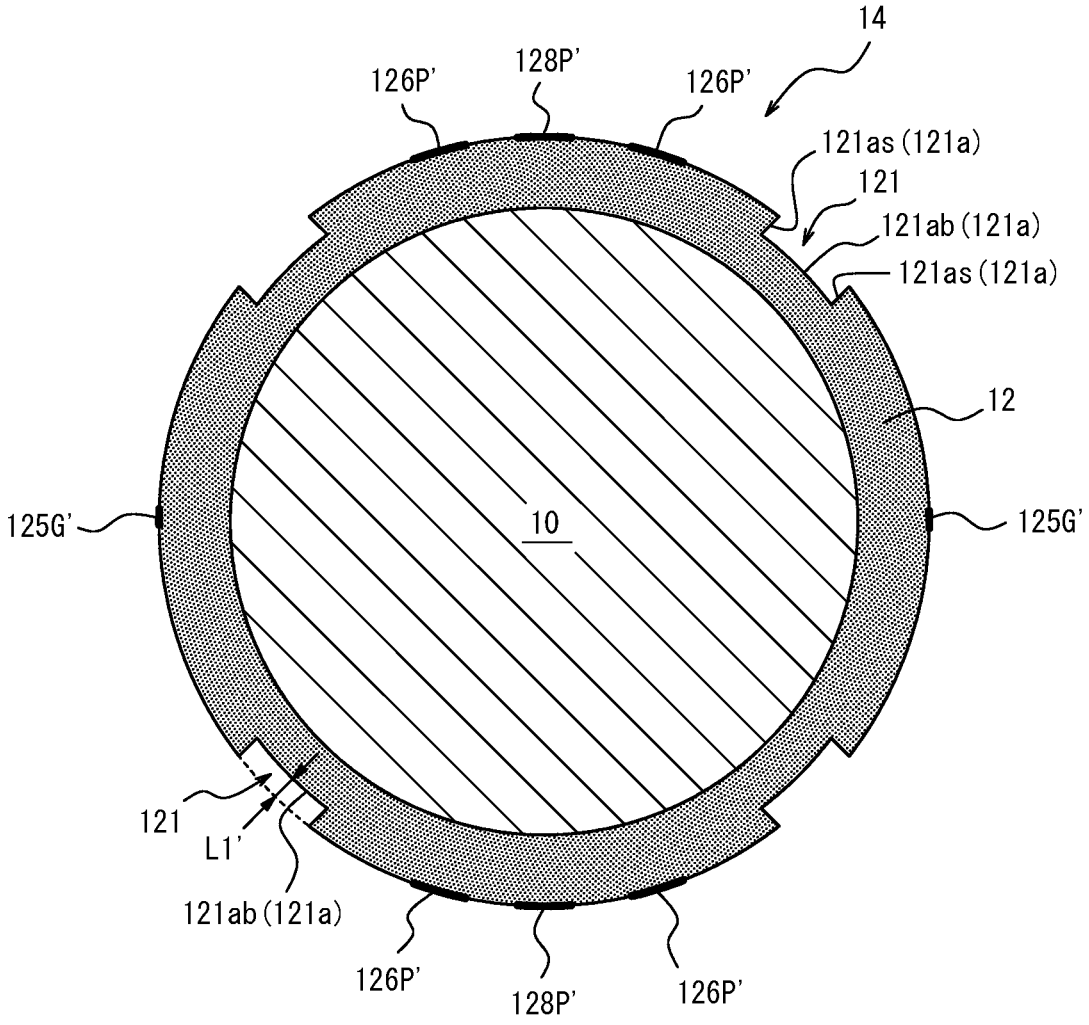
FIG. 3 illustrates an inner layer molding step in an example golf ball manufacturing method for obtaining a golf ball according to an embodiment of the present disclosure and is a cross-sectional diagram to schematically illustrate an inner ball obtained by the inner layer molding step.

In the inner layer molding step, an inner layer 12 that includes an outer surface having one or a plurality of recesses 121 is molded (FIGS. 1 to 3).

An inner ball 14 (FIG. 3) that includes at least the inner layer 12 is obtained by the inner layer molding step. The inner ball 14 obtained by the inner layer molding step includes the inner layer 12 as the outermost circumferential layer. In the present disclosure, the "inner ball" indicates a ball in a state before formation of the cover layer, described below.

In the inner layer molding step, the inner layer 12 is preferably molded using a mold 2 for inner layer molding, as in the example in FIGS. 1 and 2. In this case, the inner layer 12 is preferably molded by injection molding or compression molding (molding) using the mold 2 for inner layer molding.

The mold 2 for inner layer molding includes a cavity surface 23 for inner layer molding configured to mold the outer surface of the inner layer 12, as illustrated in FIGS. 1 and 2. The cavity surface 23 for inner layer molding defines a cavity 20 for inner layer molding. The cavity surface 23 for inner layer molding includes one or a plurality of projecting surfaces 231 that project towards the inner circumferential side. The projecting surface 231 is configured to mold the recess 121 (FIG. 3) of the inner layer 12.

When a plurality of recesses 121 is formed in the inner layer 12, for example, use of the mold 2 for inner layer molding to mold the inner layer 12 enables the positions of the recesses 121 relative to each other to be determined as expected easily in one process. The positions, relative to each other, of a plurality of inner films 13 that cover a surface 121*a* of each recesses 121 in the inner ball 14 (FIG. 5) obtained after the inner film removal step, described below, can thereby easily be set as expected.

In the inner layer molding step, the inner layer 12 may be molded on the outer circumferential side of a core ball 10, as in the example in FIGS. 1 to 3. In this case, the inner ball 14 obtained by the inner layer molding step includes the core ball 10 and the inner layer 12 positioned on the outer circumferential side of the core ball 10. The core ball 10 includes one or a plurality of layers. For example, the core ball 10 includes one or a plurality of rubber layers. In the example in FIGS. 1 to 3, the core ball 10 is formed by one rubber layer. The rubber forming the one or plurality of rubber layers that the core ball 10 can include is preferably butadiene rubber, for example. When the core ball 10 includes a plurality of rubber layers, the rubber forming each rubber layer preferably has a different composition. When the core ball 10 includes a plurality of rubber layers, the rubber forming each rubber layer preferably has a different hardness. The core ball 10 can include one or a plurality of resin layers on the outer circumferential side of the one or plurality of rubber layers.

For example, when the core ball 10 includes only one or a plurality of rubber layers as in the example in FIGS. 1 to 3, the inner layer 12 may be formed from rubber or from resin. In the example in FIGS. 1 to 3, the inner layer 12 is, for example, formed from resin.

When the core ball 10 includes one or a plurality of resin layers in addition to the one or plurality of rubber layers on the outer circumferential side of the one or plurality of rubber layers, the inner layer 12 is formed from resin.

The rubber that can form the inner layer 12 is preferably butadiene rubber, for example.

The inner layer 12 may be molded in the inner layer molding step without use of the core ball 10. In this case, the inner ball 14 obtained by the inner layer molding step includes only the inner layer 12. The inner layer 12 is preferably formed from rubber but may be formed from resin in this case.

In the example in FIGS. 1 to 3, the inner layer 12 (FIG. 3) is molded by injection molding using the mold 2 for inner layer molding. In other words, in the example in FIGS. 1 to 3, the mold 2 for inner layer molding is a mold for injection molding.

An example configuration of the mold 2 for inner layer molding for the case of the mold 2 for inner layer molding being a mold for injection molding, as in the example in FIGS. 1 to 3, is described below.

As illustrated in FIGS. 1 and 2, the mold 2 for inner layer molding includes a first mold portion 21 for inner layer molding and a second mold portion 22 for inner layer molding. The first mold portion 21 for inner layer molding and the second mold portion 22 for inner layer molding are configured to face each other. In the example in FIG. 1, the first mold portion 21 for inner layer molding and the second mold portion 22 for inner layer molding are configured to face each other in the vertical direction, and the first mold portion 21 for inner layer molding is configured to be positioned on the upper side of the second mold portion 22 for inner layer molding in the vertical direction. The first mold portion 21 for inner layer molding and the second mold portion 22 for inner layer molding may, however, be configured to face each other in any direction other than the vertical direction. The first mold portion 21 for inner layer molding may be configured to be positioned on any side, other than the upper side in the vertical direction, of the second mold portion 22 for inner layer molding.

In the present disclosure, the direction in which the first mold portion 21 for inner layer molding and the second mold portion 22 for inner layer molding are arranged facing each other in the mold 2 for inner layer molding (in the example in the drawings, the vertical direction) is referred to as the "axial direction of the mold for inner layer molding IAD". The direction perpendicular to the axial direction of the mold for inner layer molding IAD (in the example in the drawings, the horizontal direction) is referred to as the "perpendicular-to-axis direction of the mold for inner layer molding IPD".

The first mold portion 21 for inner layer molding and the second mold portion 22 for inner layer molding each include the cavity surface 23 for inner layer molding, which is recessed in a substantially hemispherical shape. When a divided face 21F, within the outer surface of the first mold portion 21 for inner layer molding, facing the second mold portion 22 for inner layer molding and a divided face 22F, within the outer surface of the second mold portion 22 for inner layer molding, facing the first mold portion 21 for inner layer molding are joined (i.e., when the mold 2 for inner layer molding is closed), the cavity surface 23 for inner layer molding in the first mold portion 21 for inner layer molding and the cavity surface 23 for inner layer molding in the second mold portion 22 for inner layer molding continuously form a substantially spherical cavity surface 23 for inner layer molding, which defines the cavity 20 for inner layer molding (FIG. 1).

The mold 2 for inner layer molding includes a plurality of gates 25G configured for injection of a molten material (such as molten resin) into the cavity 20 for inner layer molding. Each gate 25G opens to the cavity surface 23 for inner layer molding, i.e., communicates with the cavity 20 for inner layer molding. The gates 25G may be arranged at intervals in the circumferential direction, as in the example in FIGS. 1 and 2. Each gate 25G may open to the divided face 21F of the first mold portion 21 for inner layer molding and the divided face 22F of the second mold portion 22 for inner layer molding, as in the example in FIG. 1. In greater detail, the mold 2 for inner layer molding may include a main runner 241 (FIG. 2) through which molten material passes, a ringed runner 242 continuing downstream from the main runner 241 and extending in a ring along the circumferential direction, a plurality of nozzle-shaped runners 243 extending towards the inner circumferential side from the ringed runner 242, and the plurality of gates 25G communicating between the nozzle-shaped runners 243 and the cavity 20 for inner layer molding, as in the example in FIGS. 1 and 2. In this case, the ringed runner 242, each nozzle-shaped runner 243, and each gate 25G may open to the divided face 21F of the first mold portion 21 for inner layer molding and the divided face 22F of the second mold portion 22 for inner layer molding, as in the example in FIGS. 1 and 2.

In the molded article obtained immediately after injection molding, the inner ball 14 (FIG. 3) is formed continuously with excess portions molded by the ringed runner 242, the nozzle-shaped runners 243, and the gates 25G. The inner ball 14 is obtained from this molded article by removing the excess portions. At this time, inner layer gate traces 125G' (FIG. 3) from the injection molding might remain on the outer surface of the inner layer 12 of the inner ball 14 at positions corresponding to the gates 25G. For the sake of convenience, the inner layer gate traces 125G' are omitted from the drawings after FIG. 3.

The first mold portion 21 for inner layer molding and the second mold portion 22 for inner layer molding of the mold 2 for inner layer molding preferably each include a degassing hole 27 and a degassing pin (pin) 28P, inserted in the degassing hole 27, as in the example in FIG. 1. The amount of air bubbles remaining in the inner layer 12 molded by the inner layer molding step can thus be reduced. The degassing hole 27 communicates with the cavity 20 for inner layer molding. In this way, gas produced at the time of injection molding inside the cavity 20 for inner layer molding is ejected outside the cavity 20 for inner layer molding through the degassing hole 27.

In this case, inner layer degassing pin traces (inner layer pin traces) 128P' (FIG. 3) might remain on the outer surface of the inner layer 12 of the inner ball 14 obtained by the inner layer molding step at positions corresponding to the degassing pins (pins) 28P. For the sake of convenience, the inner layer degassing pin traces (inner layer pin traces) 128P' are omitted from the drawings after FIG. 3.

When the inner layer 12 is molded on the outer circumferential side of the core ball 10 in the inner layer molding step, the first mold portion 21 for inner layer molding and the second mold portion 22 for inner layer molding of the mold 2 for inner layer molding each preferably include a plurality of support pins (pins) 26P, as in the example in FIG. 1. This configuration can suppress eccentricity of the core ball 10 inside the cavity 20 for inner layer molding, thereby suppressing eccentricity of the core ball 10 in the inner ball 14 (FIG. 3) obtained by the inner layer molding step. Each support pin 26P extends in the axial direction of the mold for inner layer molding IAD and is configured to move back and forth in the axial direction of the mold for inner layer molding IAD. When the core ball 10 is housed inside the cavity 20 for inner layer molding and the mold 2 for inner layer molding is closed, each support pin 26P supports the core ball 10 so that the core ball 10 is positioned in the center of the cavity 20 for inner layer molding (FIG. 1). During injection molding (for example, while molten material is being injected inside the cavity 20 for inner layer molding), each support pin 26P recedes gradually to the outside of the cavity 20 for inner layer molding.

In this case, inner layer support pin traces (inner layer pin traces) 126P' (FIG. 3) might remain on the outer surface of the inner layer 12 of the inner ball 14 obtained by the inner layer molding step at positions corresponding to the support pins (pins) 26P. For the sake of convenience, the inner layer support pin traces (inner layer pin traces) 126P' are omitted from the drawings after FIG. 3.

[Inner Film Formation Step]

Figure 4:
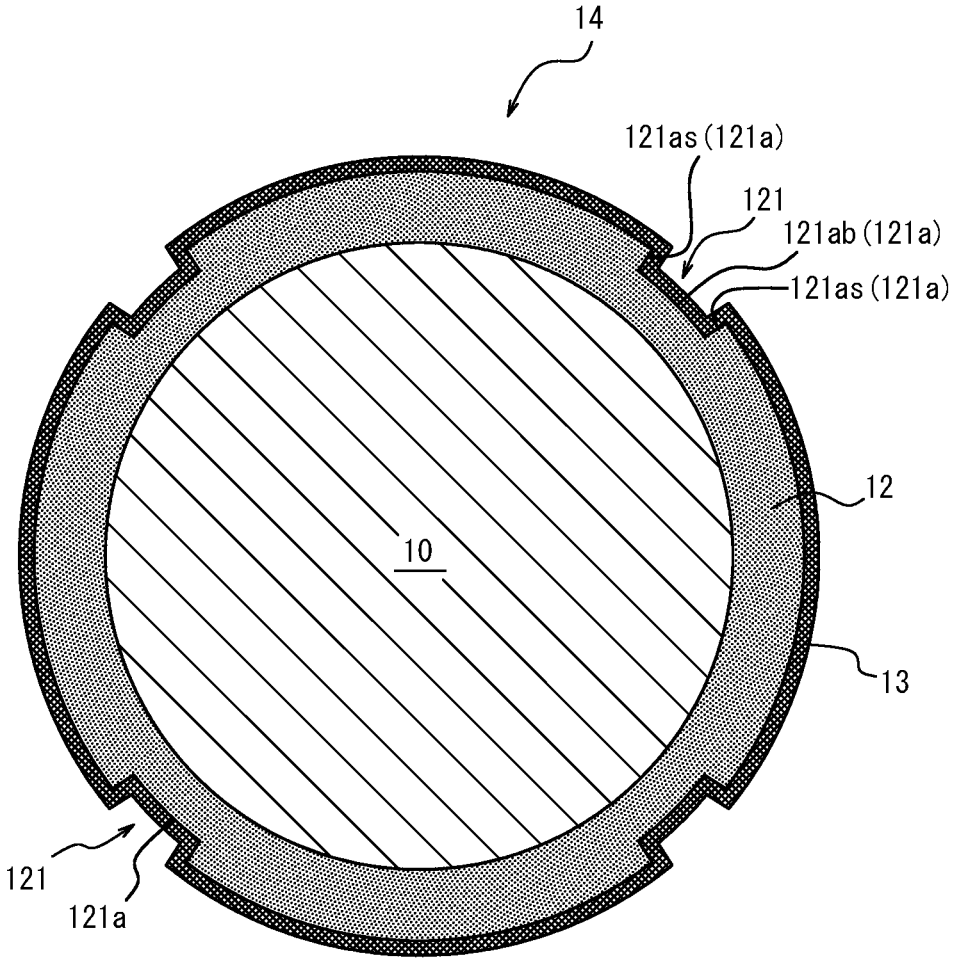
FIG. 4 illustrates an inner film formation step in an example golf ball manufacturing method for obtaining a golf ball according to an embodiment of the present disclosure and is a cross-sectional diagram to schematically illustrate an inner ball obtained by the inner film formation step.

After the inner layer molding step, the outer surface of the inner layer 12 is coated with inner film paint in the inner film formation step, thereby forming an inner film 13 (FIG. 4).

The inner ball 14 obtained by the inner film formation step includes at least the inner layer 12 and the inner film 13 that covers the outer circumferential side of the inner layer 12.

In the inner film formation step, it suffices to form the inner film 13 by coating at least the entire bottom surface 121*ab* of the recess 121 on the outer surface of the inner layer 12 with the inner film paint so as to cover at least the entire bottom surface 121*ab* of the recess 121. In the inner film formation step, the inner film 13 is preferably formed by coating at least the entire surface 121*a* (the bottom surface 121*ab* and side surfaces 121*as*) of the recess 121 on the outer surface of the inner layer 12 with the inner film paint so as to cover at least the entire surface 121*a* of the recess 121. The inner film 13 is more preferably formed in the inner film formation step by coating the entire outer surface of the inner layer 12 with the inner film paint so as to cover the entire outer surface of the inner layer 12, as this approach facilitates the operation to coat with the inner film paint.

The method for coating with the inner film paint is preferably spray painting or dipping, for example.

The inner layer 12 and the inner film 13 (and therefore the inner film paint) are different colors from each other. Here, "different colors from each other" refers to how the hue, saturation, and/or brightness differ from each other. The inner layer 12 and the inner film 13 preferably have different hues from each other. The inner layer 12 and the inner film 13 preferably have different color tones from each other.

The inner layer 12 and the inner film 13 (and therefore the inner film paint) are each preferably opaque.

The inner film 13 (and therefore the inner film paint) is preferably colored. Here, "colored" refers to having a hue other than white and to not being colorless and transparent.

[Drying Step]

After the inner film formation step and before the inner film removal step, described below, the inner film 13 is dried in the drying step (FIG. 4).

Performance of the drying step facilitates the below-described inner film removal step and can reduce drooping of the inner film 13, which covers the surface 121*a* of the recess 121, while the below-described inner film removal step is performed.

However, the drying step may be omitted.

[Inner Film Removal Step]

Figure 5:
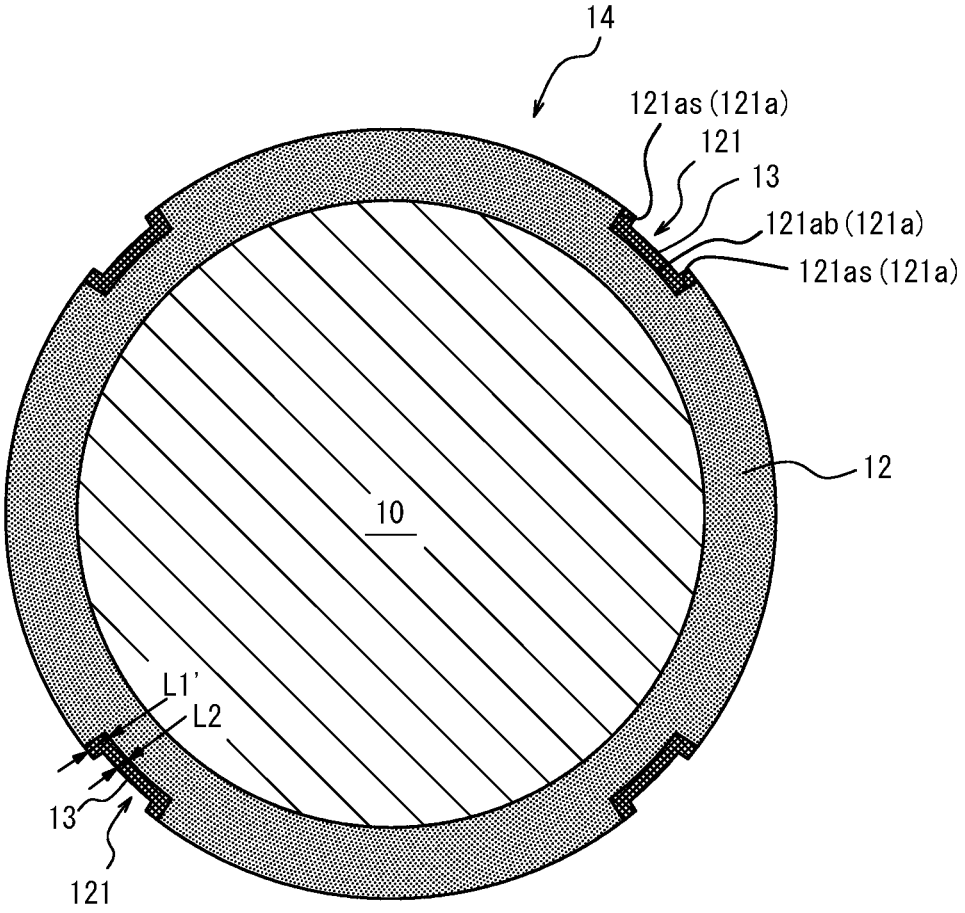
FIG. 5 illustrates an inner film removal step in an example golf ball manufacturing method for obtaining a golf ball according to an embodiment of the present disclosure and is a cross-sectional diagram to schematically illustrate an inner ball obtained by the inner film removal step.
Figure 6:
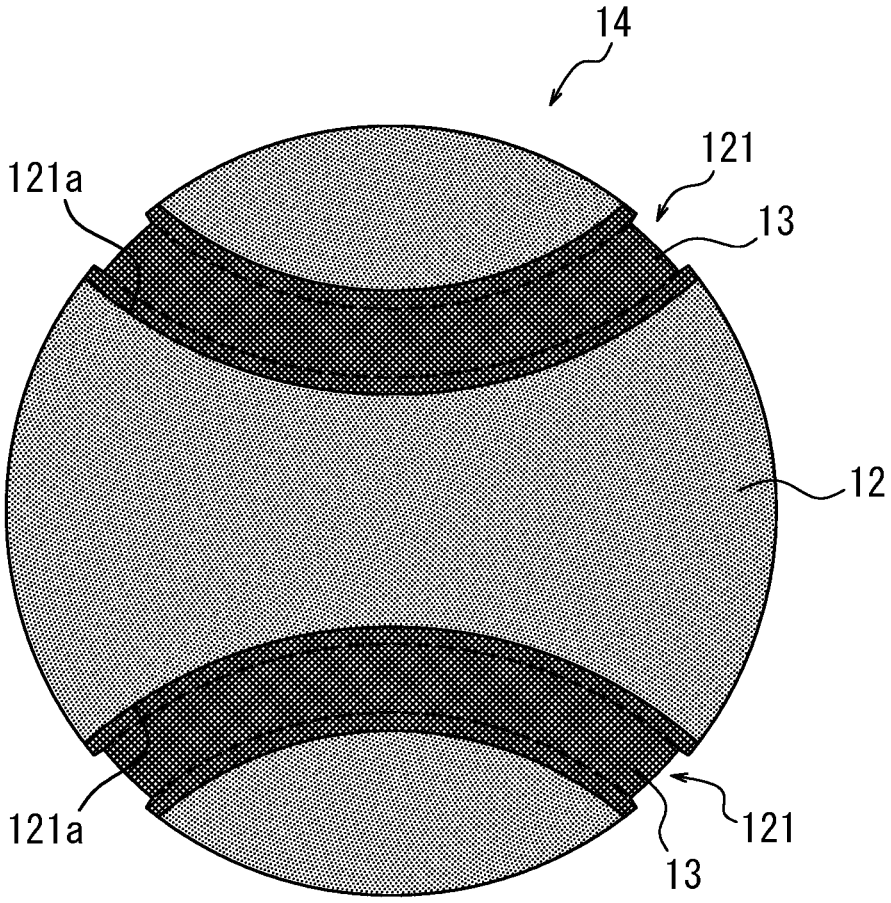
FIG. 6 illustrates an inner film removal step in an example golf ball manufacturing method for obtaining a golf ball according to an embodiment of the present disclosure and is a side view to schematically illustrate the inner ball of FIG. 5.

After the inner film formation step, the inner film 13 formed by the inner film formation step is removed, except for the portion of the inner film 13 covering the surface 121*a* of the recess 121, in the inner film removal step (FIGS. 5 and 6). Only the inner film 13 other than the portion of the inner film 13 covering the surface 121*a* of the recess 121 in the inner film 13 formed by the inner film formation step is preferably removed in the inner film removal step. In the case of performing the above-described drying step, the inner film removal step is performed after the drying step.

The inner ball 14 obtained by the inner film removal step includes at least the inner layer 12 and the inner film 13 that covers only the surface 121*a* of the recess 121 on the outer surface of the inner layer 12. It suffices for the inner film 13 to cover at least the entire bottom surface 121*ab* of the recess 121, but the inner film 13 preferably covers the entire surface 121*a* (bottom surface 121*ab* and side surfaces 121*as*) of the recess 121, as in the example in FIG. 5.

Examples of the method for removing only the inner film 13 other than the portion of the inner film 13 covering the surface 121*a* of the recess 121 in the inner film 13 formed by the inner film formation step include using a barrel grinding machine to grind the inner ball 14 (FIG. 4), obtained by the inner film formation step, gradually from the outer circumferential side to the position of the outer surface of the inner layer 12.

[Cover Layer Molding Step]

Figure 7:
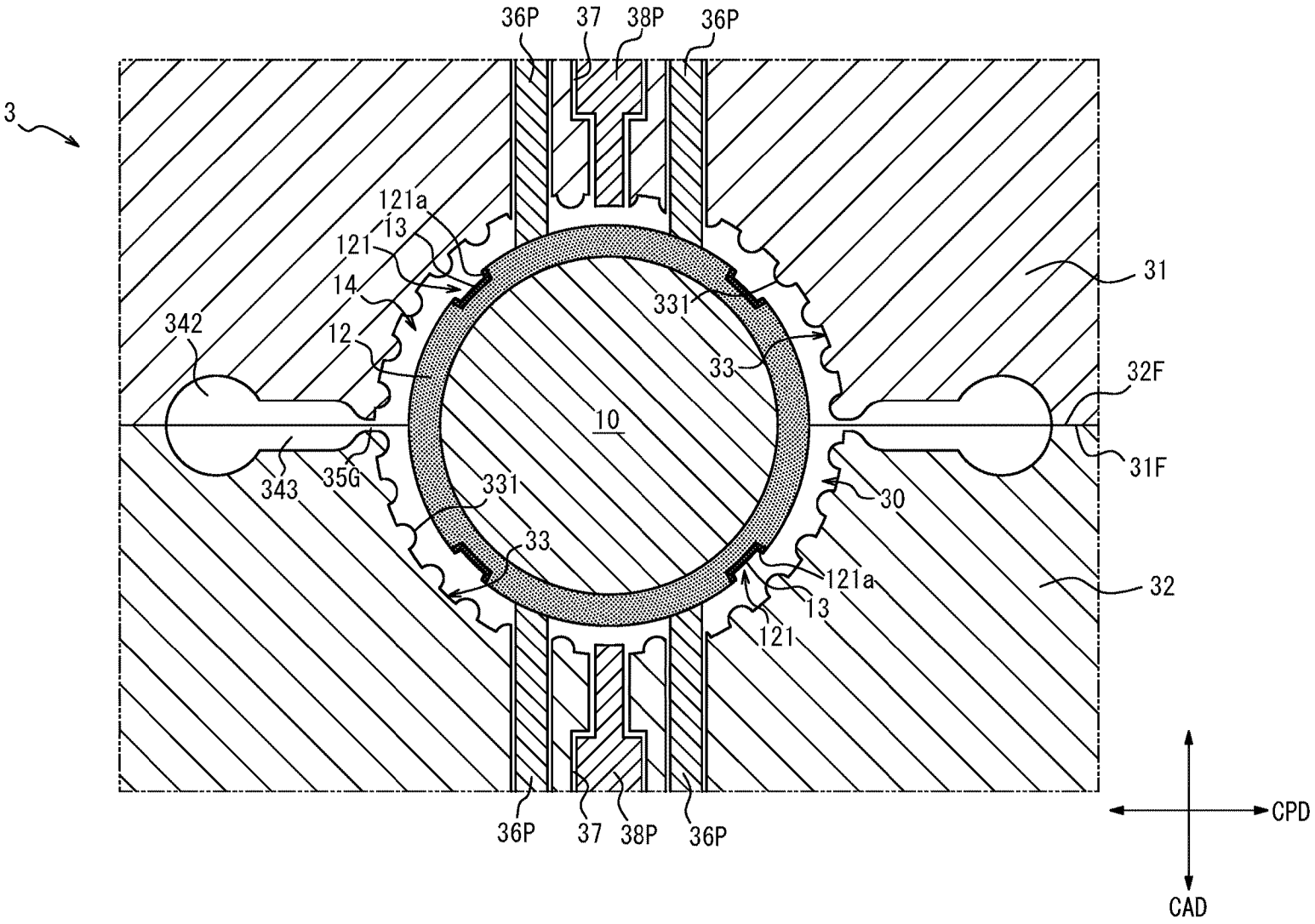
FIG. 7 illustrates a positioning step for cover layer molding and a cover layer molding step in an example golf ball manufacturing method for obtaining a golf ball according to an embodiment of the present disclosure and is a cross-sectional diagram in the axial direction of a mold for cover layer molding to schematically illustrate the mold for cover layer molding used in the cover layer molding step.
Figure 8:
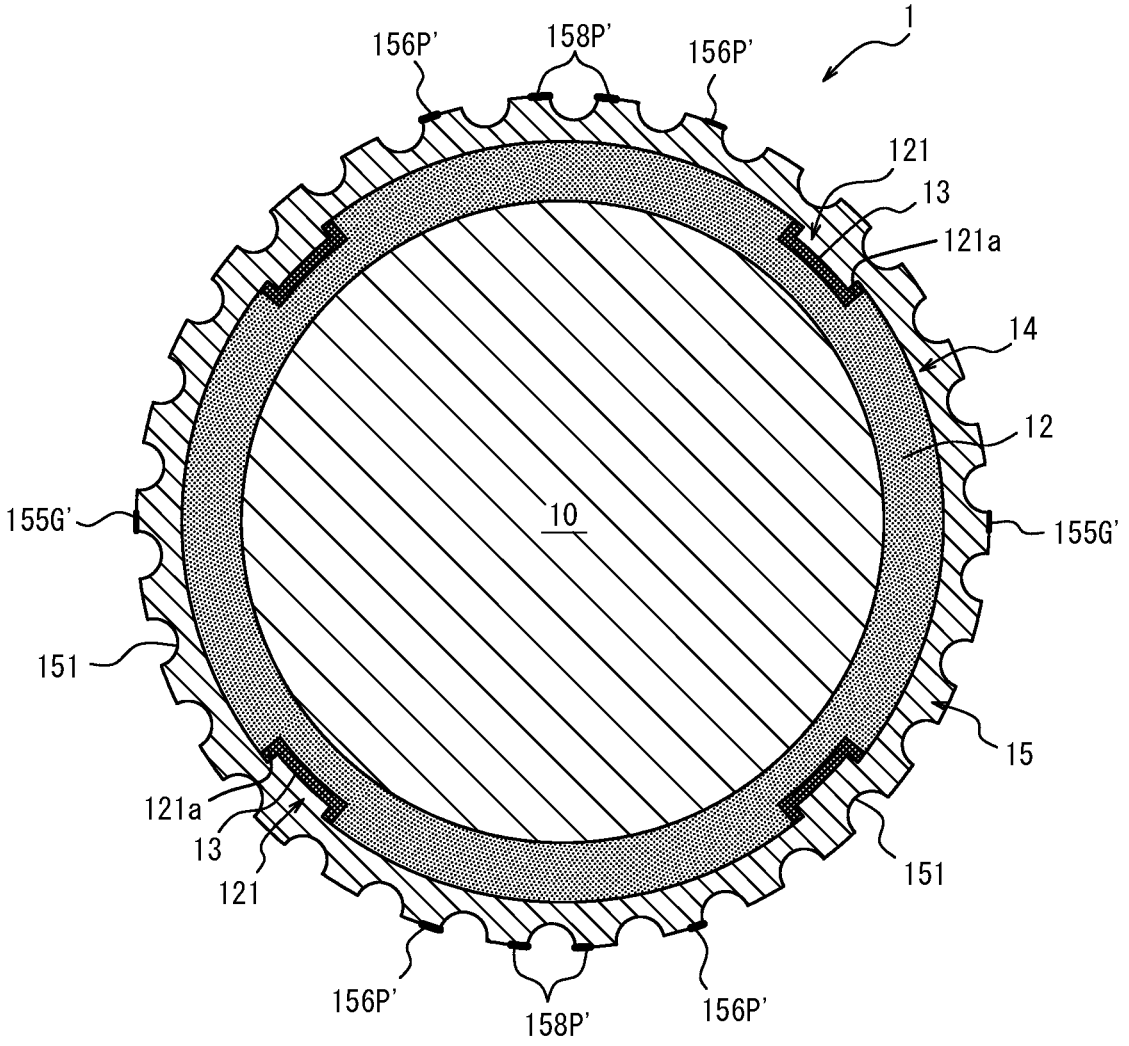
FIG. 8 illustrates a cover layer molding step in an example golf ball manufacturing method for obtaining a golf ball according to an embodiment of the present disclosure and is a cross-sectional diagram to schematically illustrate a golf ball obtained by the cover layer molding step.
Figure 9:
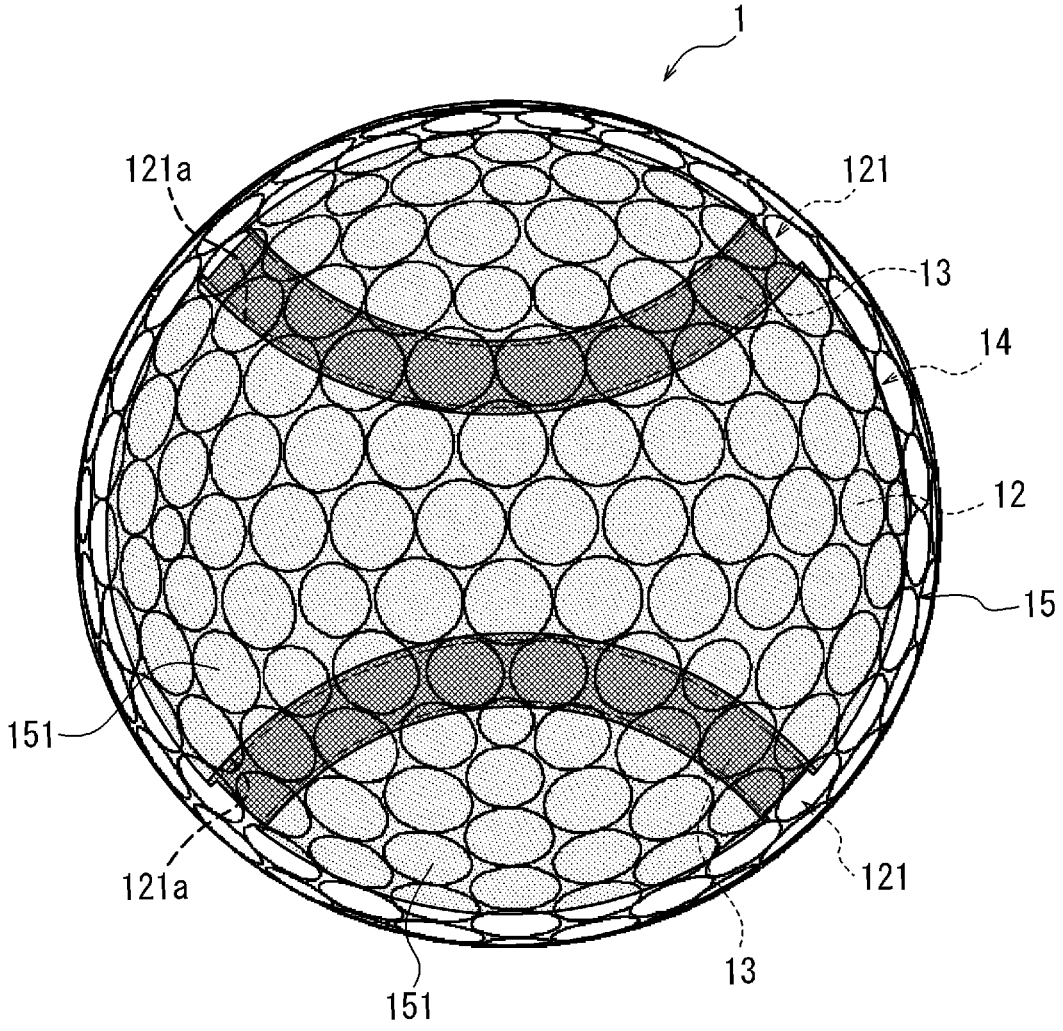
FIG. 9 illustrates a cover layer molding step in an example golf ball manufacturing method for obtaining a golf ball according to an embodiment of the present disclosure and is a side view to schematically illustrate a golf ball obtained by the cover layer molding step.

After the inner film removal step, a cover layer 15 including the outer surface that has multiple dimples 151 is molded on the outer circumferential side of the inner ball 14 (FIGS. 7 to 9).

A golf ball 1 including the inner ball 14 and the cover layer 15 positioned on the outer circumferential side of the inner ball 14 is obtained by the cover layer molding step. The golf ball 1 obtained by the cover layer molding step includes the cover layer 15 as the outermost circumferential layer. The cover layer 15 covers the outer surface of the inner ball 14. The dimples 151 are formed on the cover layer 15 but not on the inner ball 14 (and therefore not on the inner layer 12). In other words, the cover layer 15 has a maximum thickness equal to or greater than (preferably exceeding) the depth of the dimples 151. The maximum thickness of the cover layer 15 corresponds to the thickness of the cover layer 15 when measured at a portion other than the dimples 151 (land portion) on the outer surface of the cover layer 15.

The cover layer 15 is, for example, formed from urethane or ionomer.

The cover layer 15 is transparent or semi-transparent. As illustrated in FIG. 9, the exterior of the inner ball 14 can thereby be seen through the cover layer 15 when the golf ball 1 is viewed.

In the present disclosure, "transparent" refers to a visible light transmittance of 60% or higher, "semi-transparent" refers to a visible light transmittance of 30% or higher and less than 60%, and "opaque" refers to a visible light transmittance of less than 30%. The "visible light transmittance" is the average of the measured values of light transmittance as measured every nm in the 380 to 780 nm wavelength region. The "visible light transmittance" can be calculated by using a sample of the same thickness and material as the cover layer, or a sample of the cover layer directly peeled off from a finished product golf ball, and measuring the light transmittance every 1 nm in the 380 to 780 nm wavelength region using, for example, any appropriate ultraviolet-visible spectrophotometer.

The cover layer 15 is preferably transparent. This enables clearer viewing of the exterior of the inner ball 14 through the cover layer 15 when the golf ball 1 is viewed. For the same reason, the visible light transmittance of the cover layer 15 is more preferably 70% or more, and even more preferably 80% or more.

The cover layer 15 is preferably colorless but may be colored.

In the cover layer molding step, the cover layer 15 is preferably molded using a mold 3 for cover layer molding, as in the example in FIG. 7. In this case, the cover layer 15 is preferably molded by injection molding or compression molding (molding) using the mold 3 for cover layer molding.

The mold 3 for cover layer molding includes a cavity surface 33 for cover layer molding configured to mold the outer surface of the cover layer 15, as illustrated in FIG. 7. The cavity surface 33 for cover layer molding defines a cavity 30 for cover layer molding. The cavity surface 33 for cover layer molding includes multiple protruding surfaces 331 for dimple molding that project towards the inner circumferential side. The protruding surfaces 331 for dimple molding are configured to mold the dimples 151 of the cover layer 15.

In the example in FIG. 7, the cover layer 15 is molded by injection molding using the mold 3 for cover layer molding. In other words, in the example in FIG. 7, the mold 3 for cover layer molding is a mold for injection molding.

An example configuration of the mold 3 for cover layer molding for the case of the mold 3 for cover layer molding being a mold for injection molding, as in the example in FIG. 7, is described below.

The mold 3 for cover layer molding has a similar configuration to that of the mold 2 for inner layer molding illustrated in FIG. 1. As illustrated in FIG. 7, the mold 3 for cover layer molding includes a first mold portion 31 for cover layer molding and a second mold portion 32 for cover layer molding. The first mold portion 31 for cover layer molding and the second mold portion 32 for cover layer molding are configured to face each other. In the example in FIG. 7, the first mold portion 31 for cover layer molding and the second mold portion 32 for cover layer molding are configured to face each other in the vertical direction, and the first mold portion 31 for cover layer molding is configured to be positioned on the upper side of the second mold portion 32 for cover layer molding in the vertical direction. The first mold portion 31 for cover layer molding and the second mold portion 32 for cover layer molding may, however, be configured to face each other in any direction other than the vertical direction. The first mold portion 31 for cover layer molding may be configured to be positioned on any side, other than the upper side in the vertical direction, of the second mold portion 32 for cover layer molding.

In the present disclosure, the direction in which the first mold portion 31 for cover layer molding and the second mold portion 32 for cover layer molding are arranged facing each other in the mold 3 for cover layer molding (in the example in the drawings, the vertical direction) is referred to as the "axial direction of the mold for cover layer molding CAD". The direction perpendicular to the axial direction of the mold for cover layer molding CAD (in the example in the drawings, the horizontal direction) is referred to as the "perpendicular-to-axis direction of the mold for cover layer molding CPD".

The first mold portion 31 for cover layer molding and the second mold portion 32 for cover layer molding each include the cavity surface 33 for cover layer molding, which is recessed in a substantially hemispherical shape. When a divided face 31F, within the outer surface of the first mold portion 31 for cover layer molding, facing the second mold portion 32 for cover layer molding and a divided face 32F, within the outer surface of the second mold portion 32 for cover layer molding, facing the first mold portion 31 for cover layer molding are joined (i.e., when the mold 3 for cover layer molding is closed), the cavity surface 33 for cover layer molding in the first mold portion 31 for cover layer molding and the cavity surface 33 for cover layer molding in the second mold portion 32 for cover layer molding continuously form a substantially spherical cavity surface 33 for cover layer molding, which defines the cavity 30 for cover layer molding (FIG. 7).

The mold 3 for cover layer molding includes a plurality of gates 35G configured for injection of a molten material (such as fused urethane or molten ionomer) into the cavity 30 for cover layer molding. Each gate 35G opens to the cavity surface 33 for cover layer molding, i.e., communicates with the cavity 30 for cover layer molding. The gates 35G may be arranged at intervals in the circumferential direction, as in the example in FIG. 7. Each gate 35G may open to the divided face 31F of the first mold portion 31 for cover layer molding and the divided face 32F of the second mold portion 32 for cover layer molding, as in the example in FIG. 7. In greater detail, the mold 3 for cover layer molding may include a main runner (not illustrated) through which molten material passes, a ringed runner 342 continuing downstream from the main runner and extending in a ring along the circumferential direction, a plurality of nozzle-shaped runners 343 extending towards the inner circumferential side from the ringed runner 342, and the plurality of gates 35G communicating between the nozzle-shaped runners 343 and the cavity 30 for cover layer molding, as in the example in FIG. 7. In this case, the ringed runner 342, each nozzle-shaped runner 343, and each gate 35G may open to the divided face 31F of the first mold portion 31 for cover layer molding and the divided face 32F of the second mold portion 32 for cover layer molding, as in the example in FIG. 7.

In the molded article obtained immediately after injection molding, the golf ball 1 (FIG. 8) is formed continuously with excess portions molded by the ringed runner 342, the nozzle-shaped runners 343, and the gates 35G. The golf ball 1 is obtained from this molded article by removing the excess portions. At this time, cover layer gate traces 155G' (FIG. 8) from the injection molding might remain on the outer surface of the cover layer 15 of the golf ball 1 at positions corresponding to the gates 35G. For the sake of convenience, the cover layer gate traces 155G' are omitted from the drawings after FIG. 8.

The first mold portion 31 for cover layer molding and the second mold portion 32 for cover layer molding of the mold 3 for cover layer molding preferably each include a degassing hole 37 and a degassing pin (pin) 38P, inserted in the degassing hole 37, as in the example in FIG. 7. The amount of air bubbles remaining in the cover layer 15 molded by the cover layer molding step can thus be reduced. The degassing hole 37 communicates with the cavity 30 for cover layer molding. In this way, gas produced at the time of injection molding inside the cavity 30 for cover layer molding is ejected outside the cavity 30 for cover layer molding through the degassing hole 37.

In this case, cover layer degassing pin traces (cover layer pin traces) 158P' (FIG. 8) might remain on the outer surface of the cover layer 15 of the golf ball 1 obtained by the cover layer molding step at positions corresponding to the degassing pins (pins) 38P. For the sake of convenience, the cover layer degassing pin traces (cover layer pin traces) 158P' are omitted from the drawings after FIG. 8.

The first mold portion 31 for cover layer molding and the second mold portion 32 for cover layer molding of the mold 3 for cover layer molding preferably each include a plurality of support pins (pins) 36P, as in the example in FIG. 7. This configuration can suppress eccentricity of the inner ball 14 inside the cavity 30 for cover layer molding, thereby suppressing eccentricity of the inner ball 14 in the golf ball 1 (FIG. 8) obtained by the cover layer molding step. Each support pin 36P extends in the axial direction of the mold for cover layer molding CAD and is configured to move back and forth in the axial direction of the mold for cover layer molding CAD. When the inner ball 14 is housed inside the cavity 30 for cover layer molding and the mold 3 for cover layer molding is closed, each support pin 36P supports the inner ball 14 so that the inner ball 14 is positioned in the center of the cavity 30 for cover layer molding (FIG. 7). During injection molding (for example, while molten material is being injected inside the cavity 30 for cover layer molding), each support pin 36P recedes gradually to the outside of the cavity 30 for cover layer molding.

In this case, cover layer support pin traces (cover layer pin traces) 156P' (FIG. 8) might remain on the outer surface of the cover layer 15 of the golf ball 1 obtained by the cover layer molding step at positions corresponding to the support pins (pins) 36P. For the sake of convenience, the cover layer support pin traces (cover layer pin traces) 156P' are omitted from the drawings after FIG. 8.

[Surface Treatment Step]

After the cover layer molding step, surface treatment is performed on the cover layer 15 in the surface treatment step.

The surface treatment on the cover layer 15 is preferably plasma treatment, for example. A stamp 16 (FIG. 10) formed by the below-described printing step and a coating layer 17 (FIG. 11) formed by the below-described coating layer formation step thereby adhere more firmly to the outer circumferential side of the cover layer 15.

However, the surface treatment step may be omitted.

[Printing Step]

After the cover layer molding step, a mark, logo, or the like is printed on the outer surface of the golf ball 1 in the printing step.

Figure 10:
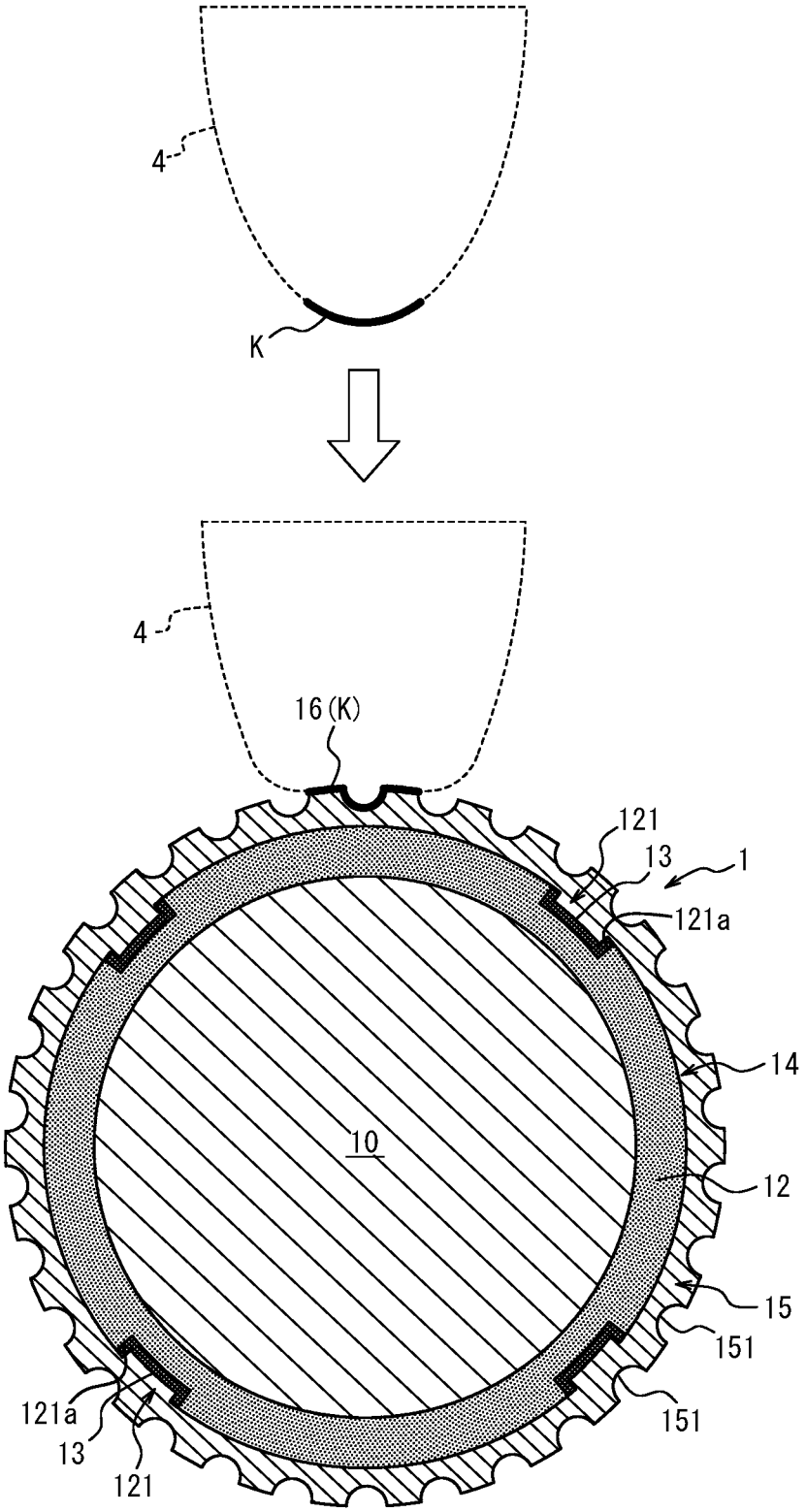
FIG. 10 illustrates a positioning step for printing and a printing step in an example golf ball manufacturing method for obtaining a golf ball according to an embodiment of the present disclosure and is a cross-sectional diagram to schematically illustrate a golf ball obtained by the printing step together with a printing member.

The printing step can, for example, be a pad printing step. In the pad printing step, a printing member 4 formed by the printing pad of a pad printing machine (not illustrated) is used for pad printing on the outer surface of the golf ball 1 (FIG. 10).

In the case of performing the aforementioned surface treatment step, the printing step is performed after the surface treatment step. The printing step is performed once or multiple times. The stamp 16 is formed on the outer circumferential side of the cover layer 15 by the printing.

The golf ball 1 obtained by the printing step includes at least the inner ball 14, the cover layer 15 positioned on the outer circumferential side of the inner ball 14, and one or a plurality of stamps 16 positioned on the outer circumferential side of the cover layer 15.

The printing member 4 used in the pad printing step is provided in the pad printing machine (not illustrated). Ink K is applied to a printing portion of the printing member 4 (the tip of the printing member 4, at the lower end in FIG. 10). The printing portion of the printing member 4 is pressed against the outer surface of the golf ball 1, thereby transferring the ink K applied to the printing portion of the printing member 4 onto the outer surface of the golf ball 1 to form the stamp 16.

Figure 12:
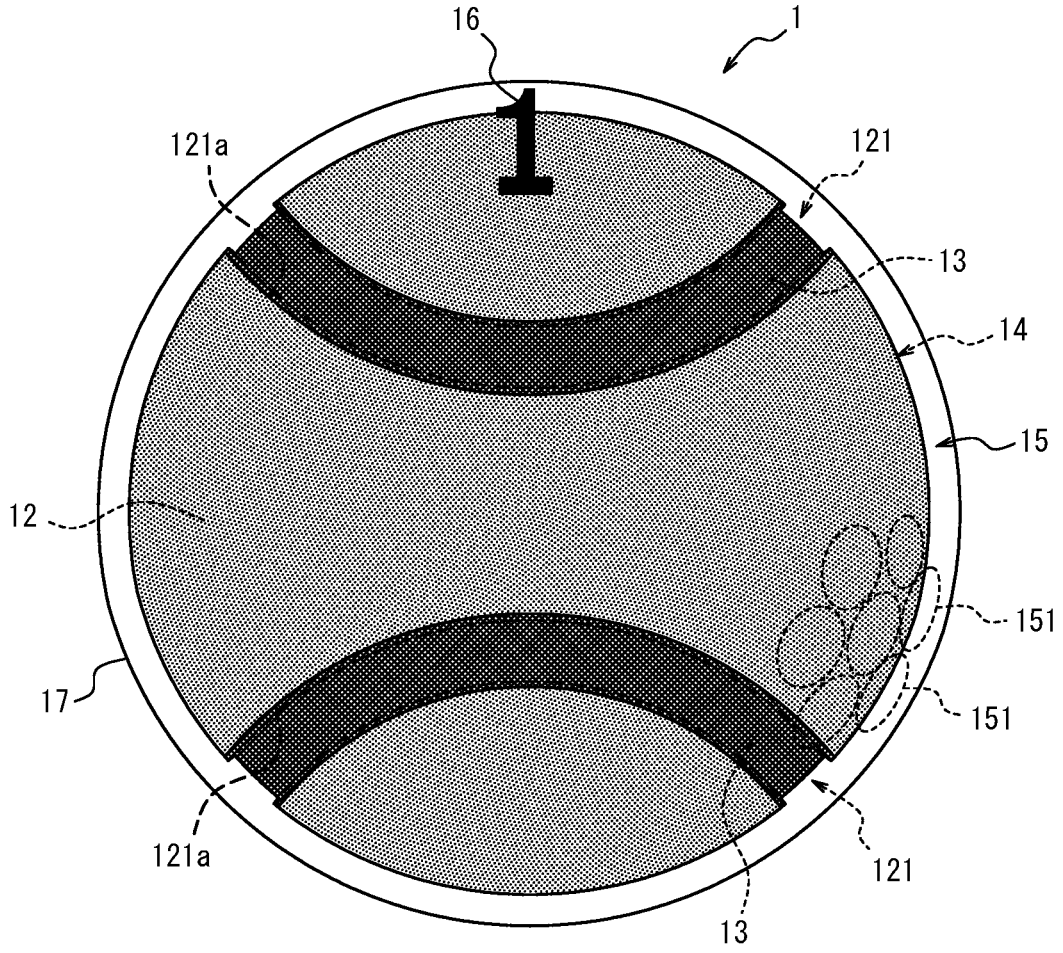
FIG. 12 illustrates a coating layer formation step in an example golf ball manufacturing method for obtaining a golf ball according to an embodiment of the present disclosure and is a side view to schematically illustrate a golf ball according to an embodiment of the present disclosure obtained by the coating layer formation step.

As illustrated in FIG. 12, the stamp 16 may represent one or more characters (numbers, letters, or the like), symbols, and/or patterns, for example. The stamp 16 may thereby represent a mark, logo, and/or design, for example.

The stamp 16 (and therefore the ink K) is preferably opaque, as this facilitates visibility of the stamp 16. The stamp 16 (and therefore the ink K) and the inner layer 12 are preferably different colors, as this facilitates visibility of the stamp 16. The stamp 16 (and therefore the ink K) and the inner film 13 may be different colors from each other or the same color as each other. Here, "the same color as each other" refers to how the hue, saturation, and brightness are all the same.

The printing step may be a thermal transfer printing step or the like instead of a pad printing step.

The printing step need not be performed.

[Coating Layer Formation Step]

Figure 11:
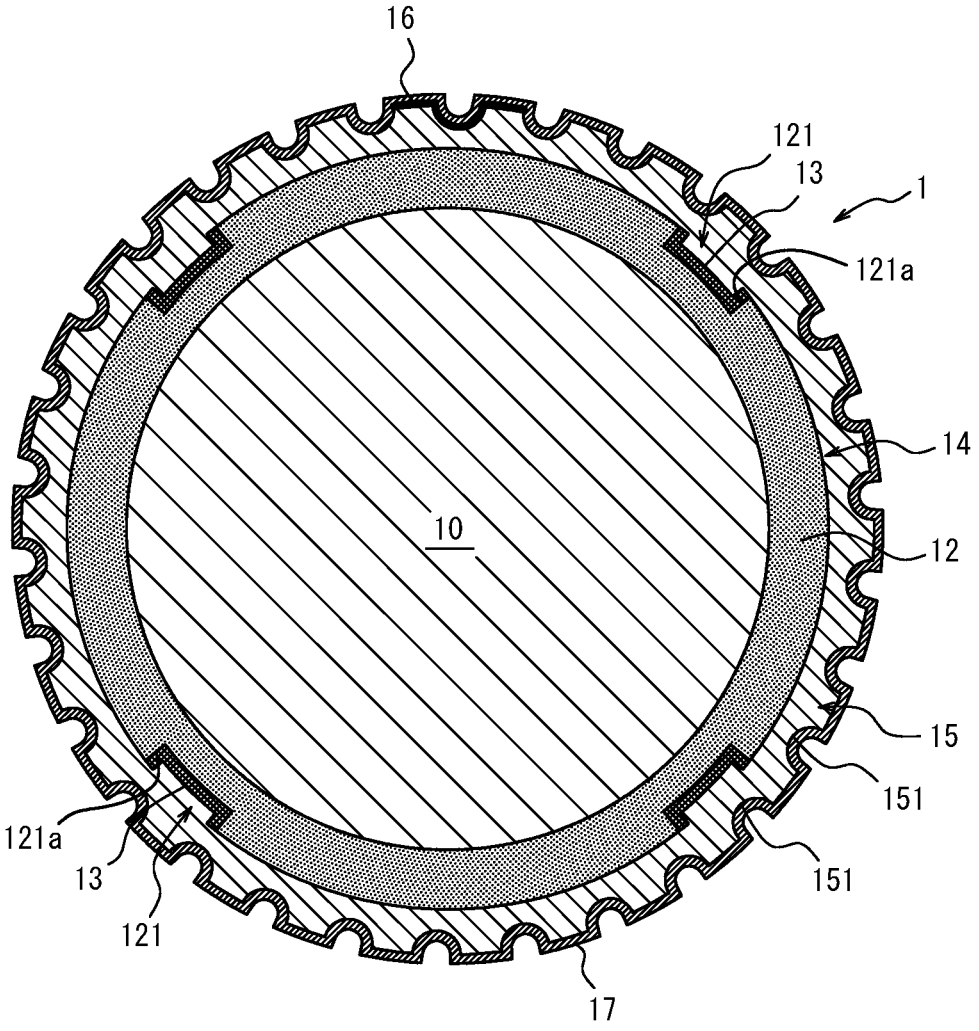
FIG. 11 illustrates a coating layer formation step in an example golf ball manufacturing method for obtaining a golf ball according to an embodiment of the present disclosure and is a cross-sectional diagram to schematically illustrate a golf ball according to an embodiment of the present disclosure obtained by the coating layer formation step.

After the cover layer molding step, the outer circumferential side of the cover layer 15 is coated with coating layer paint in the coating layer formation step, thereby forming the coating layer 17 (FIGS. 11, 12). In the case of performing the aforementioned surface treatment step, the coating layer formation step is performed after the surface treatment step. In the case of performing the aforementioned printing step, the coating layer formation step is preferably performed after the printing step but may be performed before the printing step.

The golf ball 1 obtained by the coating layer formation step includes at least the inner ball 14, the cover layer 15 positioned on the outer circumferential side of the inner ball 14, and the coating layer 17 positioned on the outer circumferential side of the cover layer 15.

In the coating layer formation step, the entire outer surface of the cover layer 15 is preferably coated with the coating layer paint, thereby forming the coating layer 17 to cover the entire outer surface of the cover layer 15.

The coating layer 17 is formed to a thickness that does not completely fill the dimples 151, as illustrated in FIG. 11. In other words, the thickness of the coating layer 17 is less than the depth of the dimples 151. The thickness of the coating layer 17 is preferably 10 μm to 15 μm.

The coating layer 17 is preferably transparent or semi-transparent. As illustrated in FIG. 12, the exterior of the inner ball 14 can thereby be seen through the coating layer 17 (and the cover layer 15) when the golf ball 1 is viewed. The coating layer 17 is preferably colorless but may be colored.

The method for coating with the coating layer paint is preferably spray painting or dipping, for example.

The coating layer formation step need not be performed.

The effects of the present embodiment are now described.

The golf ball 1 according to the present embodiment includes the inner ball 14 and the cover layer 15 that covers the outer surface of the inner ball 14 and includes an outer surface with the dimples 151. The inner ball 14 includes the inner layer 12, which includes an outer surface with the recess 121, and the inner film 13 that covers only the surface 121*a* of the recess 121 on the outer surface of the inner layer 12. The inner layer 12 and the inner film 13 are different colors from each other, and the cover layer 15 is transparent or semi-transparent.

By the inner layer 12 and the inner film 13 being different colors from each other, the golf ball 1 can have a design represented by the contrast between the inner layer 12 and inner film 13, thereby improving the designability of the golf ball 1. By the cover layer 15 being transparent or semi-transparent, the design can be seen through the cover layer 15 when the golf ball 1 is viewed.

Since the inner film 13 is covered by the cover layer 15, which has a maximum thickness equal to or greater than the depth of the dimples 151, peeling of the inner film 13 (film) due to impact, such as when the golf ball 1 is hit, can more effectively be suppressed than if the inner film 13 were formed on the outer circumferential side of the cover layer 15. The formation position of the inner film 13 could be restricted by the presence of the dimples 151 if the inner film 13 were formed on the outer circumferential side of the cover layer 15. In the present embodiment, however, the inner film 13 can be formed at any position regardless of the position of the dimples 151. The degree of freedom for design is thereby increased.

The expected design can easily be achieved when the inner film 13 that covers only the surface 121*a* of the recess 121 on the outer surface of the inner layer 12 is obtained through the inner layer molding step, the inner film formation step, and the inner film removal step.

Details, preferred configurations, modifications, and the like of the golf ball of the present disclosure and a golf ball manufacturing method for obtaining the golf ball of the present disclosure are now described.

In each example described in the present disclosure, a projection height L1 (FIG. 1) of the projecting surface 231 of the cavity surface 23 for inner layer molding in the mold 2 for inner layer molding is preferably 5 mm or less and more preferably is 3 mm. This configuration can suppress unevenness in the flow of material inside the cavity 20 for inner layer molding due to the presence of the projecting surface 231 in the inner layer molding step. Eccentricity of the core ball 10 inside the cavity 20 for inner layer molding, for example, can therefore be suppressed.

The "projection height L1" (FIG. 1) of the projecting surface 231 is defined as the distance from the base of the projecting surface 231 to the projection tip of the projecting surface 231 as measured along a perpendicular to the base of the projecting surface 231. The "base" of the projecting surface 231 refers to an imaginary surface yielded by extending the cavity surface 23 for inner layer molding smoothly towards the projecting surface 231, as illustrated by the dashed line in FIG. 1.

For the same reason, in each example described in the present disclosure, a depth L1' (FIG. 3) of the recess 121 in the inner layer 12 is preferably 5 mm or less and more preferably is 3 mm or less.

The "depth L1" (FIG. 3) of the recess 121 is defined as the distance from the open end face of the recess 121 to the bottom surface 121*ab* of the recess 121 as measured along a perpendicular to the open end face of the recess 121. The "open end face" of the recess 121 refers to an imaginary surface yielded by extending the outer surface of the inner layer 12 smoothly towards the recess 121, as illustrated by the dashed line in FIG. 3.

In each example described in the present disclosure, the projection height L1 (FIG. 1) of the projecting surface 231 of the cavity surface 23 for inner layer molding in the mold 2 for inner layer molding used in the inner layer molding step (FIGS. 1 to 3) is preferably 0.5 mm or more. When the inner film 13 covering the outer circumferential side of the inner layer 12 is ground using a grinder, for example, during the inner film removal step (FIGS. 5 and 6), this range can help to prevent the inner film 13 covering the surface 121*a* of the recess 121 from also being ground.

For the same reason, in each example described in the present disclosure, the depth L1' (FIG. 3) of the recess 121 in the inner layer 12 is preferably 0.5 mm or more.

In each example described in the present disclosure, the inner film 13 (and therefore the inner film paint) preferably includes polyurethane, in particular a two-component curable polyurethane that uses a polyol and a polyisocyanate. This configuration can suppress peeling of the inner film 13 when the cover layer 15 and the inner film 13 rub together due to impact, such as when the golf ball 1 is hit.

In the example illustrated in FIG. 5, the thickness L2 (FIG. 5) of the inner film 13 covering the surface 121*a* of the recess 121 in the inner layer 12 is smaller than the depth L1' (FIG. 5) of the recess 121 in the inner layer 12.

Figure 13:
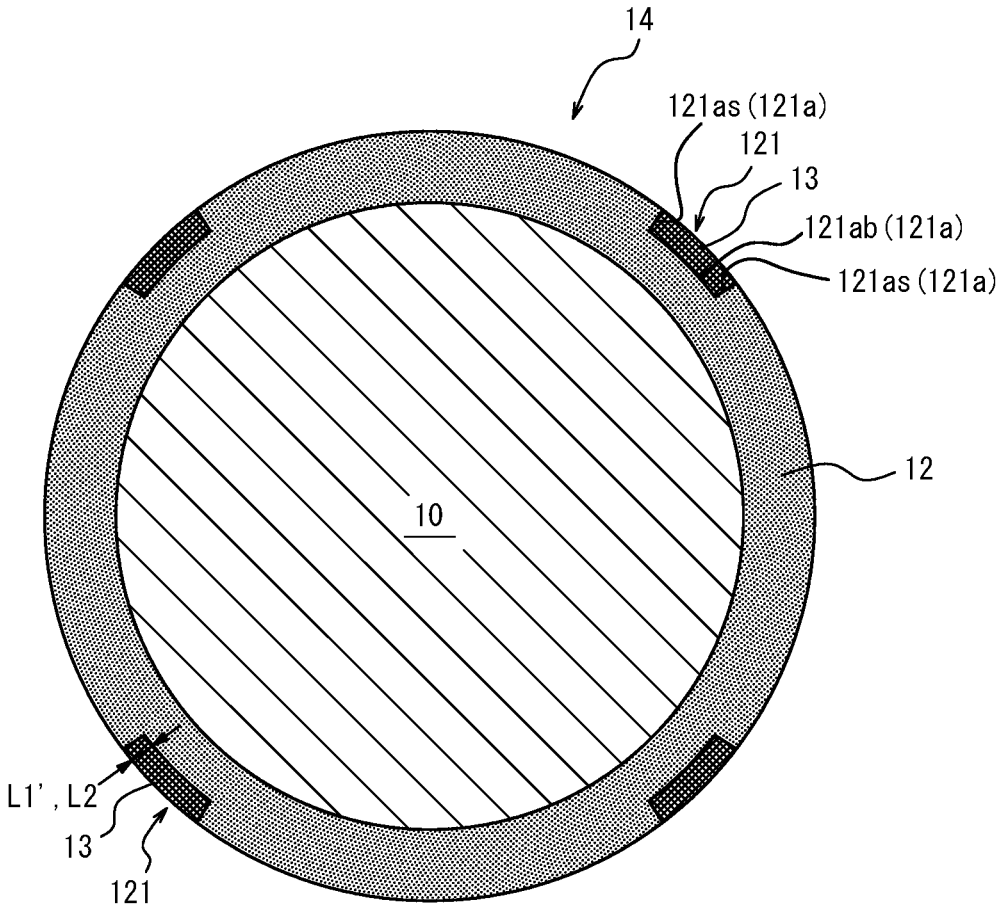
FIG. 13 is a cross-sectional diagram to schematically illustrate an inner ball obtained by an inner film removal step in an example golf ball manufacturing method for obtaining a golf ball according to a modification of the present disclosure.

In each example described in the present disclosure, however, the thickness L2 (FIG. 13) of the inner film 13 covering the surface 121*a* of the recess 121 in the inner layer 12 may be the same as the depth L1' (FIG. 13) of the recess 121 in the inner layer 12.

The thickness L2 of the inner film 13 covering the surface 121*a* of the recess 121 in the inner layer 12 is preferably 10 μm to 15 μm.

In each example described in the present disclosure, a pretreatment step of pretreating the inner layer 12 is preferably performed after the inner layer molding step (FIGS. 1 to 3) and before the inner film formation step (FIG. 4).

The pretreatment of the inner layer 12 is preferably plasma treatment and/or primer treatment, for example. The inner film 13 formed in the inner film formation step thereby adheres more firmly to the outer circumferential side of the inner layer 12. Consequently, peeling of the inner film 13 when the cover layer 15 and the inner film 13 rub together due to impact, such as when the golf ball 1 is hit, can be suppressed.

However, the pretreatment step may be omitted.

In each example described in the present disclosure, when the mold 2 for inner layer molding used in the inner layer molding step (FIGS. 1 to 3) is a mold for injection molding, the projecting surface 231 of the cavity surface 23 for inner layer molding in the mold 2 for inner layer molding preferably does not overlap the gate 25G in the radial direction, as illustrated in FIG. 1. This configuration can more reliably achieve the expected shape of the recess 121 (FIG. 3) molded by the projecting surface 231.

In the present disclosure, "overlap in the radial direction" refers to overlapping when viewing a projection in the radial direction.

For the same reason, in each example described in the present disclosure, the recess 121 of the inner layer 12 in the inner ball 14 preferably does not overlap the inner layer gate traces 125G' of the injection molding in the radial direction, as illustrated in FIG. 3.

In each example described in the present disclosure, the projecting surface 231 of the cavity surface 23 for inner layer molding in the mold 2 for inner layer molding used in the inner layer molding step preferably does not overlap the pins 26P, 28P (support pins 26P and/or degassing pins 28P) in the radial direction, as illustrated in FIG. 1. This configuration can more reliably achieve the expected shape of the recess 121 (FIG. 3) molded by the projecting surface 231.

For the same reason, in each example described in the present disclosure, the recess 121 of the inner layer 12 in the inner ball 14 preferably does not overlap the inner layer pin traces 126P', 128P' (inner layer support pin traces 126P' and/or inner layer degassing pin traces 128P') in the radial direction, as illustrated in FIG. 3.

In each example described in the present disclosure, a positioning step for cover layer molding (FIG. 7) of positioning the inner ball 14 in the cavity 30 for cover layer molding of the mold 3 for cover layer molding is preferably performed after the inner film removal step (FIGS. 5 and 6) and before the cover layer molding step (FIGS. 7 to 9).

The positioning step for cover layer molding may be performed automatically by an inner ball positioning apparatus (not illustrated) or may be performed manually. In the case of the positioning step for cover layer molding being performed by the inner ball positioning apparatus, the inner ball positioning apparatus preferably detects the position of the inner film 13 of the inner ball 14 relative to the cavity 30 for cover layer molding by image processing, and based on the detection result, positions the inner ball 14 within the cavity 30 for cover layer molding.

In the case of molding the cover layer 15 by injection molding using the mold 3 for cover layer molding in the cover layer molding step (FIGS. 7 to 9), the inner ball 14 is preferably positioned within the cavity 30 for cover layer molding in the positioning step for cover layer molding in such a way that the inner film 13 covering the surface 121*a* of the recess 121 does not face the gate 35G in the radial direction (i.e., does not overlap the gate 35G in the radial direction), as in the example in FIG. 7. In this way, when the injection molding is performed in the cover layer molding step (FIGS. 7 to 9), high-temperature and high-pressure molten material injected from the gate 35G into the cavity 30 for cover layer molding can be prevented from directly contacting the inner film 13 and causing the inner film 13 to melt away.

For the same reason, in each example described in the present disclosure, the inner film 13 covering the surface 121*a* of the recess 121 in the golf ball 1 preferably does not overlap the cover layer gate traces 155G' from the injection molding in the radial direction, as illustrated in FIG. 8.

In each example described in the present disclosure, the inner ball 14 may be positioned within the cavity 30 for cover layer molding of the mold 3 for cover layer molding in the positioning step for cover layer molding in such a way that the inner film 13 covering the surface 121*a* of the recess 121 does not face the pins 36P, 38P (support pin 36P and/or degassing pin 38P) in the radial direction (i.e., does not overlap the pins 36P, 38P in the radial direction), as in the example in FIG. 7. This configuration can suppress a decrease in visibility of the inner film 13 covering the surface 121*a* of the recess 121 due to the cover layer pin traces 156P', 158P' when the golf ball 1 (FIG. 8) is viewed from the exterior. Alternatively, the inner ball 14 may be positioned within the cavity 30 for cover layer molding of the mold 3 for cover layer molding in the positioning step for cover layer molding in such a way that the inner film 13 covering the surface 121*a* of the recess 121 faces the pins 36P, 38P (support pin 36P and/or degassing pin 38P) in the radial direction (i.e., overlaps the pins 36P, 38P in the radial direction).

Similarly, in each example described in the present disclosure, the inner film 13 covering the surface 121*a* of the recess 121 need not overlap the cover layer pin traces 156P', 158P' (cover layer support pin trace 156P' and/or cover layer degassing pin trace 158P') in the radial direction in the golf ball 1, as illustrated in FIG. 8. Alternatively, the inner film 13 covering the surface 121*a* of the recess 121 may overlap the cover layer pin traces 156P', 158P' (cover layer support pin trace 156P' and/or cover layer degassing pin trace 158P') in the radial direction in the golf ball 1.

In each example described in the present disclosure, a positioning step for printing (FIG. 10) of positioning the golf ball 1 relative to the printing member 4 so that the inner film 13 covering the surface 121*a* of the recess 121 does not face the printing portion of the printing member 4 in the radial direction is preferably performed after the cover layer molding step (FIGS. 7 to 9) and before the printing step (FIG. 10). This configuration can suppress a decrease in visibility of the inner film 13 covering the surface 121*a* of the recess 121 due to the stamp 16 when the golf ball 1 (FIG. 10) obtained by the printing step (FIG. 10) is viewed from the exterior. In the case of the printing step being a pad printing step, the golf ball 1 is positioned relative to the printing member 4 in the positioning step for printing in such a way that the inner film 13 covering the surface 121*a* of the recess 121 does not face the printing portion of the printing member 4, formed by the printing pad of the pad printing machine, in the radial direction. On the other hand, in the case of the printing step being a thermal transfer printing step, the golf ball 1 is positioned relative to the printing member in the positioning step for printing in such a way that the inner film 13 covering the surface 121*a* of the recess 121 does not face the printing portion of the printing member, formed by a thermal transfer film, in the radial direction.

The positioning step for printing may be performed automatically by a golf ball positioning apparatus (not illustrated) or may be performed manually. In the case of the positioning step for printing being performed by the golf ball positioning apparatus, the golf ball positioning apparatus preferably detects the position of the inner film 13 of the golf ball 1 relative to the printing portion of the printing member by image processing, and based on the detection result, positions the golf ball 1 relative to the printing member.

For the same reason, in each example described in the present disclosure, the inner film 13 in the golf ball 1 preferably does not overlap the stamp 16 in the radial direction, as illustrated in FIG. 10.

In each example described in the present disclosure, the coating layer 17 (FIGS. 11 to 12; hence, the coating layer paint as well) preferably includes matte particles. This enables the coating layer 17 to be a matte layer without gloss or luster. The golf ball 1 can thereby have an uneven outer surface due to the dimples 151, as illustrated in FIG. 12, while at the same time rendering the dimples 151 barely visible, so that the dimples 151 appear not to exist when the golf ball 1 is viewed from the exterior. This can improve the visibility of the inner film 13 and therefore the designability. When the coating layer 17 (hence, the coating layer paint as well) includes matte particles, the coating layer paint is less likely to smear during the coating layer formation step (FIGS. 11 and 12). The coating layer paint (hence, the coating layer 17 as well) thereby more accurately follows the shape of the dimples 151, and the expected flight performance of the golf ball 1 can be achieved.

The coating layer 17 that includes matte particles (hence, the coating layer paint as well) is not restricted, but urethane paint is preferably used. Since the golf ball needs to withstand severe usage conditions, a two-component curable urethane paint is preferable, with a non-yellowing urethane paint being particularly preferable.

In the case of a two-component curable urethane paint, any of various polyols such as saturated polyester polyol, acrylic polyol, or polycarbonate polyol is preferably used as the main agent, and as an isocyanate, a non-yellowing polyisocyanate is preferably used, examples of which include an adduct such as hexamethylene diisocyanate, isophorone diisocyanate, or hydrogenated xylylene diisocyanate; biuret; isocyanurate; and mixtures thereof.

Examples of the matte particles include silica-based, melamine-based, and acrylic-based particles. Specifically, examples include silica, polymethyl methacrylate, butyl polymethacrylate, polystyrene, and butyl poly acrylate. The particles may be organic or inorganic, but silica is particularly preferable.

From the perspective of quenching and coatability, the specific surface area of the matte particles is preferably 200 $m^2/g$ to 400 $m^2/g$ as the BET specific surface area, more preferably 250 $m^2/g$ to 350 $m^2/g$.

From the perspective of spin performance and quenching, the average primary particle size of the matte particles is preferably 1.0 μm to 3.0 μm, more preferably 2.0 μm to 2.8 μm. If this value exceeds 3.0 μm, the ball surface becomes rough, which may adversely affect the spin and reduce performance. If this value is too small, on the other hand, the quenching effect may decrease.

The content of the matte particles is preferably 5 to 10 parts by mass per 100 parts by mass of the main agent (the total content of a resin component and a solvent) in the paint compound of the coating layer 17. If the content is too large, the viscosity of the paint composition increases, and the workability of the paint tends to worsen. If the content is too small, the quenching effect may decrease.

The average roughness Ra of the surface of the coating layer 17 is preferably 0.5 to 1.0 to make the spin amount of the ball during approach compatible with quenching. The average roughness Ra of the surface of the coating layer 17 refers to the arithmetic average roughness of JIS B0601 (1994).

The reflectance of the coating layer 17 measured by a gloss meter is preferably 5.0 or less at an angle of incidence of 20°, 20.0 or less at an angle of incidence of 60°, and 40.0 or less at an angle of incidence of 85°. When the reflectance is adjusted to satisfy the aforementioned numerical ranges, the coating layer 17 can be provided with a good matte effect. The conditions for measuring the reflectance with the aforementioned gloss meter are measurement of an ABS resin plate, coated to a thickness of 20 μm, using the "micro-TRI-gloss" produced by BYK.

INDUSTRIAL APPLICABILITY

A golf ball of the present disclosure can be used as any type of golf ball, such as a two-piece golf ball, a three-piece golf ball, a four-piece golf ball, a five-piece golf ball, a six-piece golf ball, or a wound golf ball.

The invention claimed is:

1. A golf ball comprising:

an inner ball; and a cover layer covering an outer surface of the inner ball and comprising an outer surface with dimples, wherein the inner ball comprises an inner layer comprising an outer surface with a recess; and an inner film covering only a surface of the recess on the outer surface of the inner layer, the inner layer and the inner film are different colors from each other, wherein the inner film comprises a two-component curable polyurethane that uses a polyol and a polyisocyanate, and the cover layer is transparent or semi-transparent.

2. The golf ball of claim 1, wherein a visible light transmittance of the cover layer is 70% or more.

3. The golf ball of claim 1, wherein a depth of the recess is 5 mm or less.

4. The golf ball of claim 1, further comprising a coating layer positioned on an outer circumferential side of the cover layer, wherein the coating layer includes matte particles.

5. The golf ball of claim 1, wherein the cover layer includes a gate trace of injection molding, and the inner film does not overlap the gate trace in a radial direction.

6. The golf ball of claim 1, wherein a stamp is formed on an outer circumferential side of the cover layer, and the inner film does not overlap the stamp in a radial direction.

* * * * *